US006230538B1

(12) United States Patent
Ribordy

(10) Patent No.: US 6,230,538 B1
(45) Date of Patent: May 15, 2001

(54) METHOD AND APPARATUS FOR DEEP DRAWING USING A ROTARY TURRET

(75) Inventor: James E. Ribordy, South Beloit, IL (US)

(73) Assignee: RD Systems, South Beloit, IL (US)

( * ) Notice: Subject to any disclaimer, the term of this patent is extended or adjusted under 35 U.S.C. 154(b) by 0 days.

(21) Appl. No.: 09/356,423

(22) Filed: Jul. 19, 1999

Related U.S. Application Data

(60) Provisional application No. 60/094,692, filed on Jul. 30, 1998.

(51) Int. Cl.[7] ..... B21D 22/28
(52) U.S. Cl. ..... 72/349; 72/379.4
(58) Field of Search ..... 72/94, 347, 349, 72/361, 379.4

(56) References Cited

U.S. PATENT DOCUMENTS

| | | | | |
|---|---|---|---|---|
| 353,190 | | 11/1886 | White . | |
| 2,434,905 | * | 1/1948 | Burt et al. | 72/349 |
| 2,728,318 | | 12/1955 | Burton | 113/113 |
| 2,872,887 | * | 2/1959 | Praturlon | 72/349 |
| 3,446,167 | * | 5/1969 | Armbruster et al. | 72/349 |
| 3,452,578 | | 7/1969 | Kirchner et al. | 72/348 |
| 3,822,576 | | 7/1974 | Hardt | 72/348 |
| 4,413,497 | | 11/1983 | Kubis et al. | 72/356 |
| 4,446,714 | | 5/1984 | Cvacho | 72/370 |
| 4,584,859 | | 4/1986 | Saunders | 72/43 |

* cited by examiner

*Primary Examiner*—Lowell A. Larson
(74) *Attorney, Agent, or Firm*—Leydig, Voit & Mayer Ltd.

(57) ABSTRACT

A method and apparatus for continuously forming cases from blanks using a rotary turret. Blanks are deposited near dies located on the turret. Each blank is centered on the rotary turret using an associated centering mechanism so that the blank is centered over the die. A punch aligned with the die is drives toward an extended position to push the blank through the die, thereby forming a case. The punch and centering mechanism retract as an ejector extends to remove the case from the die. A redraw sleeve coaxial with the punch strips the case from the punch to deposit the punch on the extended ejector. Subsequent turrets may be connected through transfer wheels to the first turret for performing redrawing operations until a case with the desired dimensions is obtained.

19 Claims, 8 Drawing Sheets

METHOD AND APPARATUS FOR DEEP DRAWING USING A ROTARY TURRET

This application claims the benefit of U.S. Provisional Application No. 60/094,692, filed Jul. 30, 1998.

FIELD OF THE INVENTION

The present invention generally relates to a method and apparatus for forming sheet metal, and more particularly relates to a method and apparatus for performing deep drawing operations.

BACKGROUND OF THE INVENTION

Sheet metal blanks are deep drawn into various shapes to form cases for use in a number of different applications. According to conventional deep drawing techniques, a blank is clamped in place over a die and a punch pushes the blank through an opening in the die to form the case. The depth of the case that can be formed in a single drawing operation depends on the tensile strength and thickness of the metal. In general, one or more redrawing operations are necessary to obtain a case with the desired depth and size.

In a specific application, blanks are drawn to form cylindrical battery cases. For example, casings for small size batteries (e.g., AA, AAA) have a relatively long side wall and a relatively small diameter. Because of the depth and small diameter, a blank typically undergoes one drawing and at least one redrawing operation to obtain the desired dimensions. Therefore, it is desirable to have a method and apparatus which performs all of the necessary drawing operations to form a blank into the desired shape and size.

Previous methods and apparatus for performing multiple drawing operations involve the use of a deep drawing transfer press. The deep drawing transfer press carries out an in-line process during which workpieces are transferred through a series of work areas. Transfer presses typically have a beam which carries a plurality of punches. The punches are aligned with matching dies so that when the beam is lowered, the punches pass through the corresponding dies. The drawing means are shaped to perform different drawing operations and are arranged so that the last set forms the desired shape.

Unfortunately, the use of a deep drawing transfer press overly limits the rate at which cases are produced. In operation, conventional transfer presses typically load a blank at a first work area corresponding to the first drawing means. The beam is then lowered so that the first punch forces the blank through the first die to perform a first drawing operation. After the first drawing operation is completed, the workpiece is transferred to a second work area for performing a second drawing operation with the second drawing means, and so on. It will be appreciated that each workpiece must dwell at each work area so that the drawing apparatus can perform the associated operation. As a result, techniques using a deep drawing transfer press proceed in a step-by-step fashion which limits the rate at which cases are formed. Accordingly, typical transfer presses have a maximum production rate of approximately 170 parts per minute. Furthermore, it will be appreciated that when the beam is lowered, it performs a number of different drawing operations simultaneously. The discrete repetition of simultaneous drawing operations creates a significant noise problem.

Deep drawing transfer presses have additional problems in transferring each workpiece through the work areas. Transfer presses typically use fingers which clamp onto the workpiece for transfer to the next work area. The workpieces are held until the next punch pushes the pieces out of the fingers while performing a drawing operation. The fingers may interfere with the drawing apparatus associated with the work area and therefore are often broken, requiring downtime for repair or replacement. In addition, the fingers may disrupt the drawing procedure, causing additional delays or slower operation of the press.

SUMMARY OF THE INVENTION

A general aim of the present invention is to provide a method for continuously forming cases from blanks.

In that regard, a more detailed object of the present invention is to provide a method and apparatus for forming cases which maximizes the rate at which the cases are formed.

A related object of the present invention is to provide deep drawing apparatus which automatically centers each blank with drawing apparatus without interfering with the drawing operation being performed.

A more detailed object of the present invention is to provide deep drawing apparatus which reduces the level of noise generated during operation.

In light of the above, it is a feature of the present invention to provide a method for deep drawing blanks into cases using rotary turrets. The blanks are fed into a rotary turret having multiple sets of drawing apparatus. Each set includes a punch, centering mechanism, and ejector. In a first turret and any intermediate turrets, each set of drawing apparatus also includes a redraw sleeve. Each turret has cams shaped to drive each set through a deep drawing operation as the turret rotates. Depending on the desired dimensions, a first and subsequent redraw turrets may be used to form cases having the desired shape and size. In light of the above, therefore, the present invention provides a method and apparatus for forming blanks into cases using rotary turrets which are continuously operated. The cams are shaped so that each set of drawing apparatus on a given turret is positioned at a different stage in the drawing operation and therefore each set completes the operation at a different time. As a result, the level of noise generated during operation of the deep drawing apparatus is minimized.

These and other objects, advantages, and features of the present invention will become more apparent from the following detailed description when taken in conjunction with the accompanying drawings.

Figure 1:
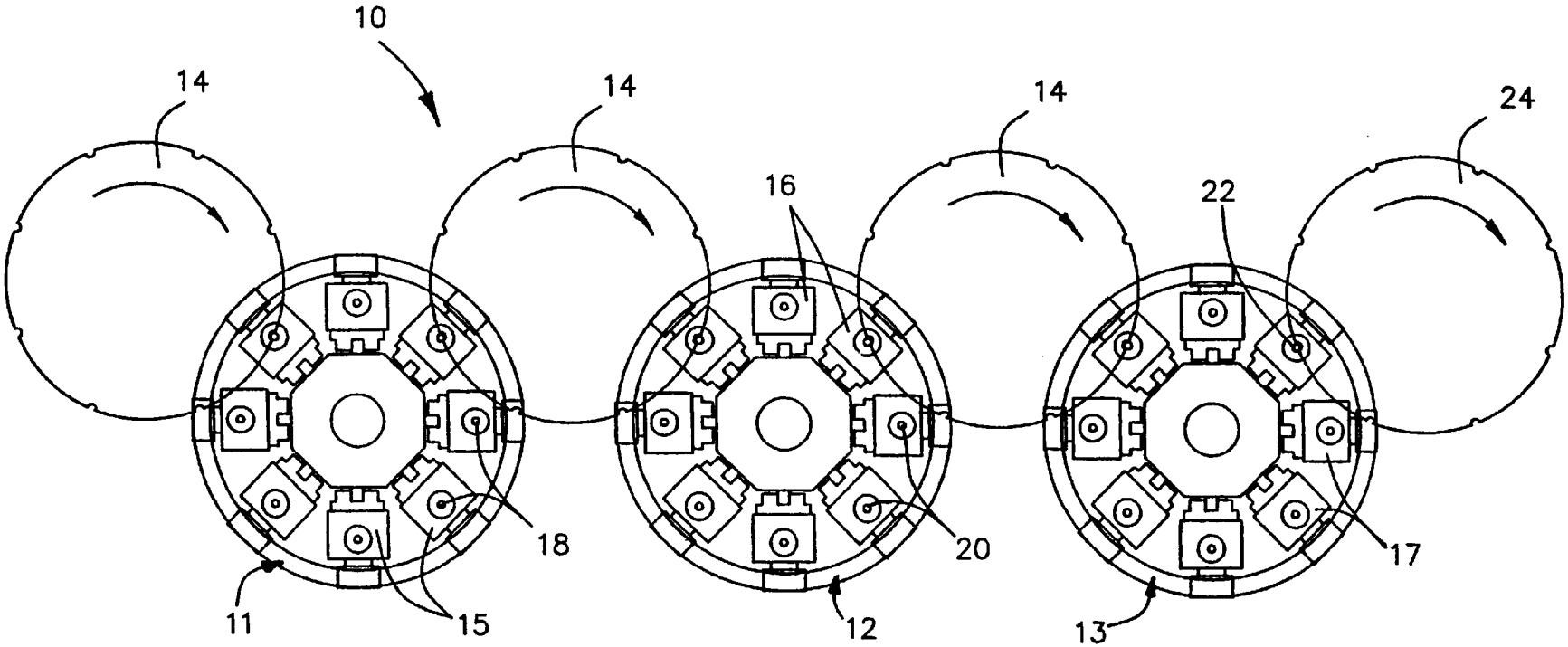
FIG. 1 is a partially schematic top view of a deep drawing apparatus of the present invention including rotary turrets and transfer wheels.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention as defined by the appended claims.

DETAILED DESCRIPTION OF THE PREFERRED EMBODIMENT

Referring now to the drawings, and specifically to FIG. 1, drawing apparatus 10 is shown generally comprising a first rotary turret 11, an intermediate rotary turret 12, and a final rotary turret 13, all connected by transfer wheels 14. The first turret 11 carries multiple first drawing sets 15 each performing a substantially identical deep drawing operation. The first drawing sets 15 are spaced radially about the turret 11 and a plurality of cams drive the first drawing sets 15 so that the deep drawing operation is performed as the turret rotates. In practicing the invention, blanks 18 are fed into the apparatus by a first transfer wheel 14 so that a blank 18 is deposited near each first drawing set 15. As the first turret 11 rotates, each first drawing set 15 performs a deep drawing operation so that the blank 18 is formed into a case 20. If one or more redrawing operations are needed, each case 20 is then conveyed by another transfer wheel 14 to an intermediate turret 12, carrying multiple intermediate drawing sets 16, or final turret 13, carrying multiple final drawing sets 17. As used herein, a workpiece is a part which is loaded into a turret and, accordingly, may take the form of a blank 18 or case 20. Once the desired case dimensions are reached, finished cases 22 are passed to an outfeed 24.

Figure 2A:
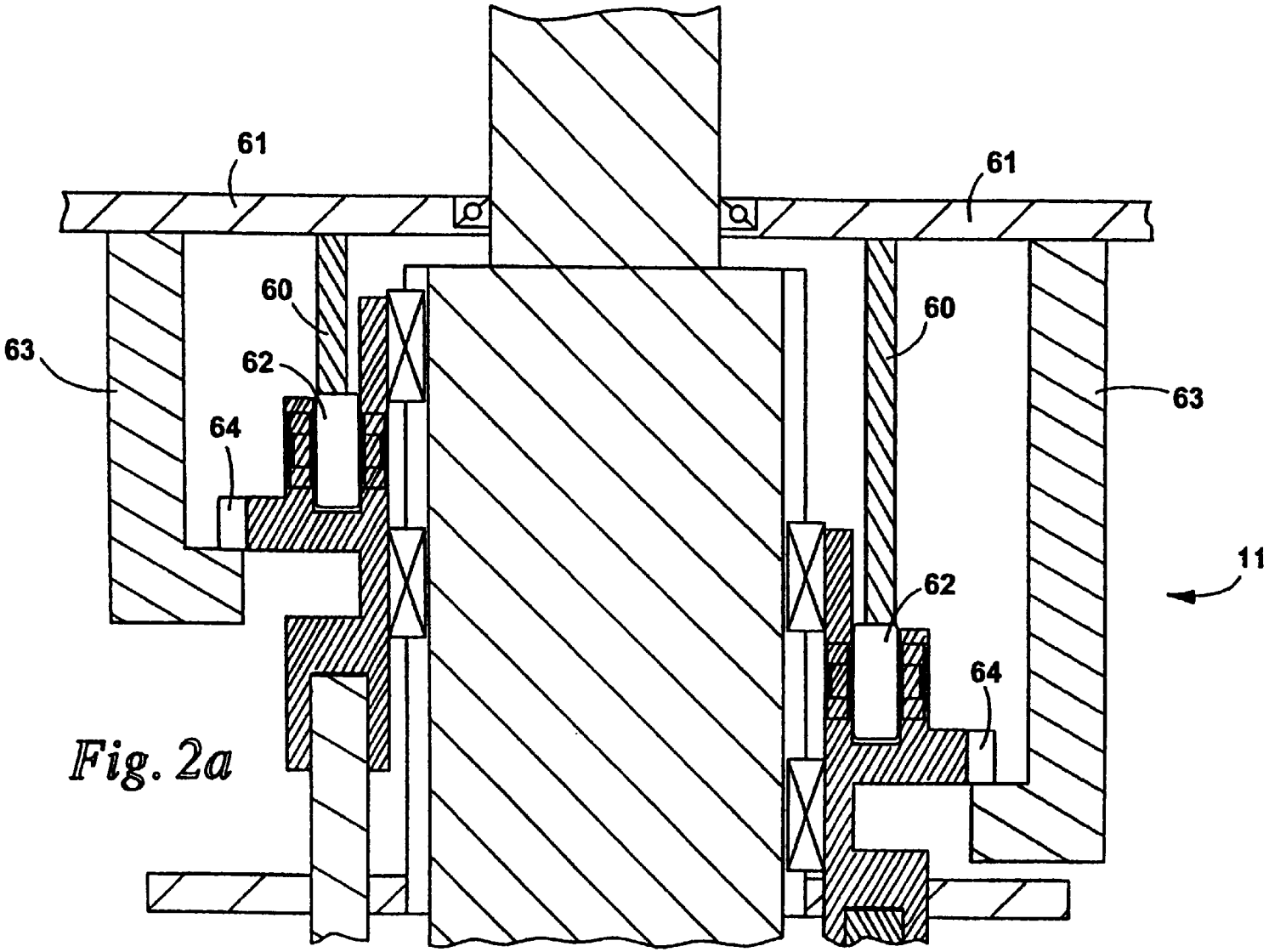
FIGS. 2*a–d* comprise a sectional side view of a rotary turret.
Figure 2B:
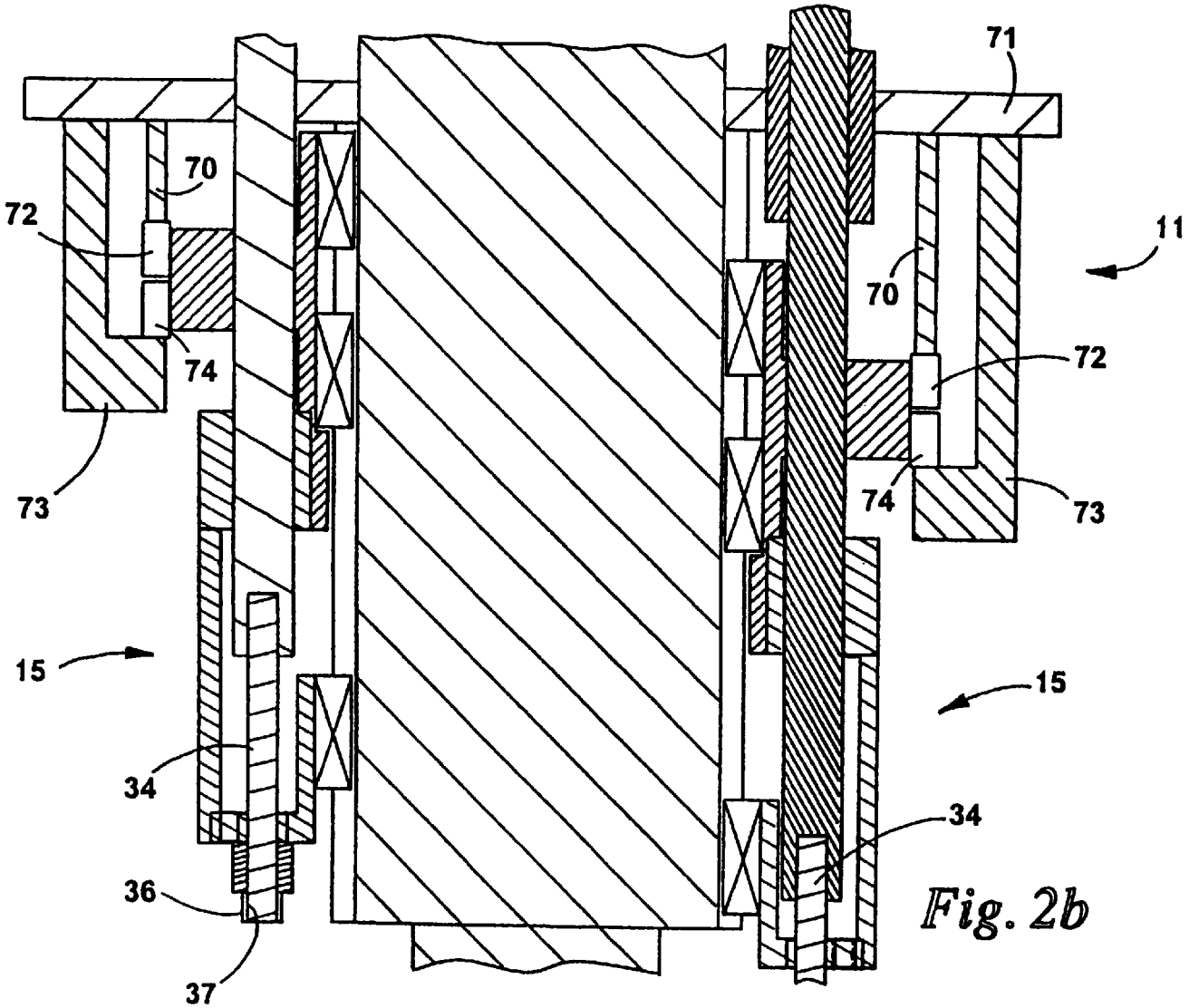
Figure 2C:
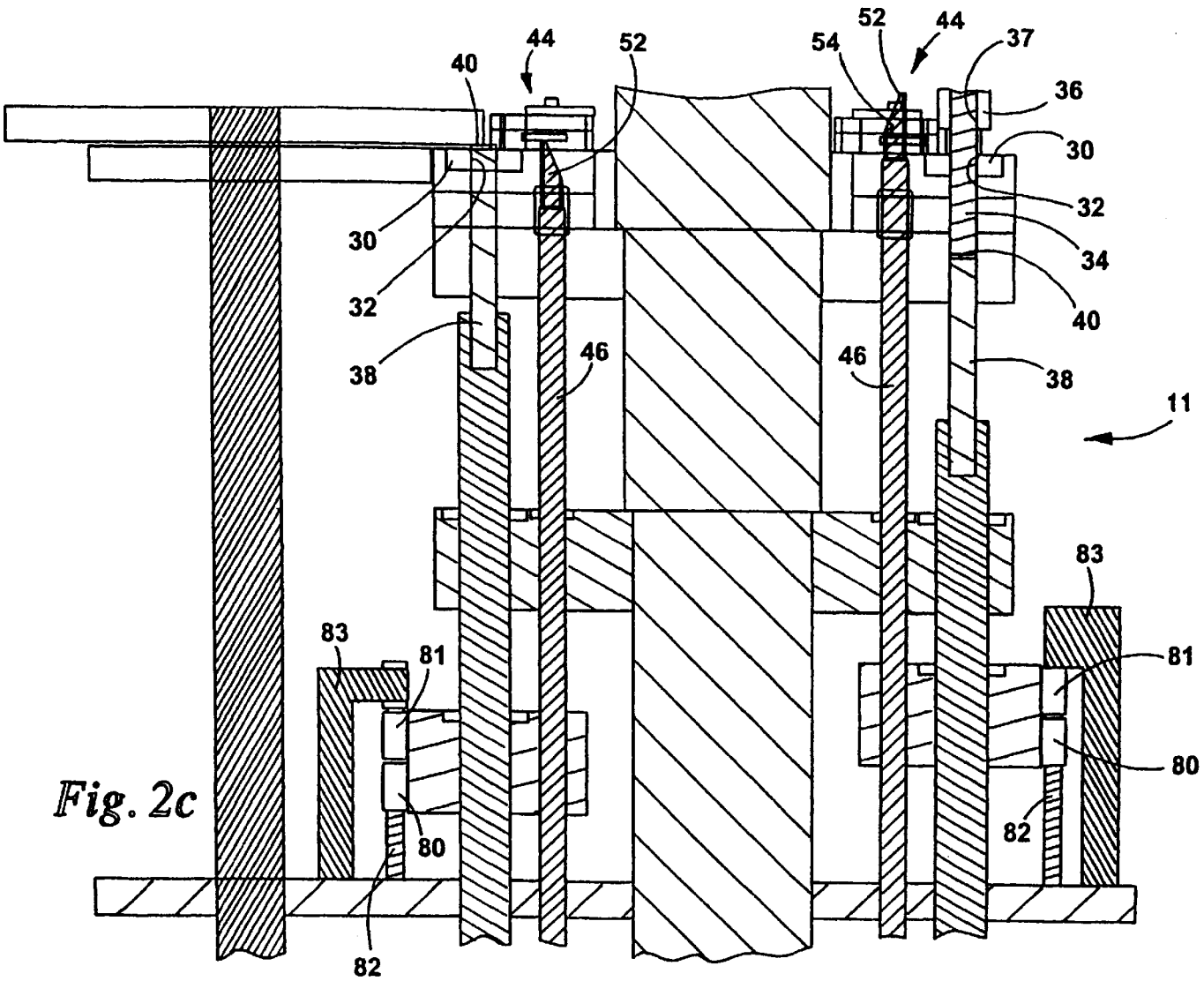
Figure 2D:
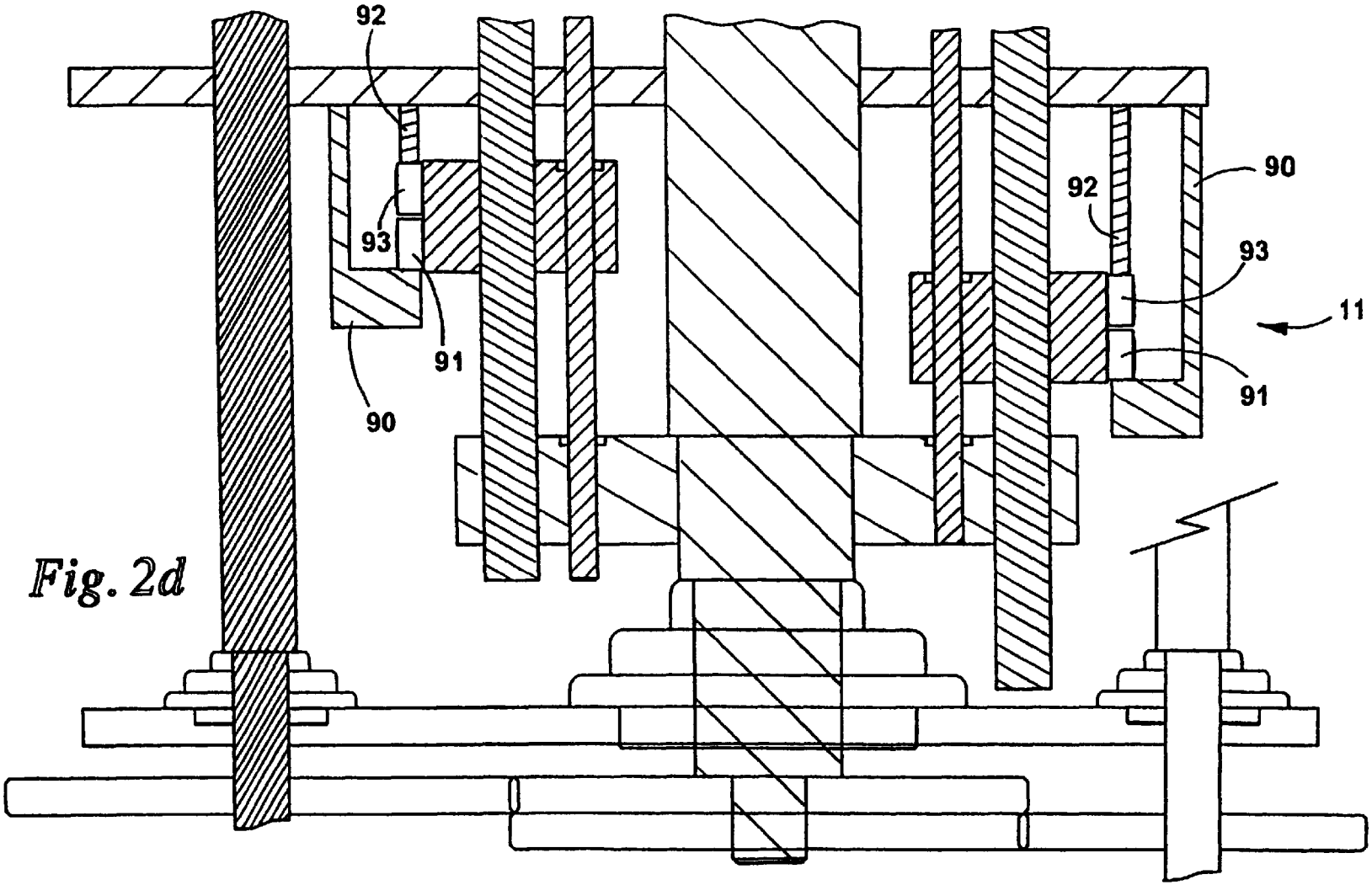
Figure 3:
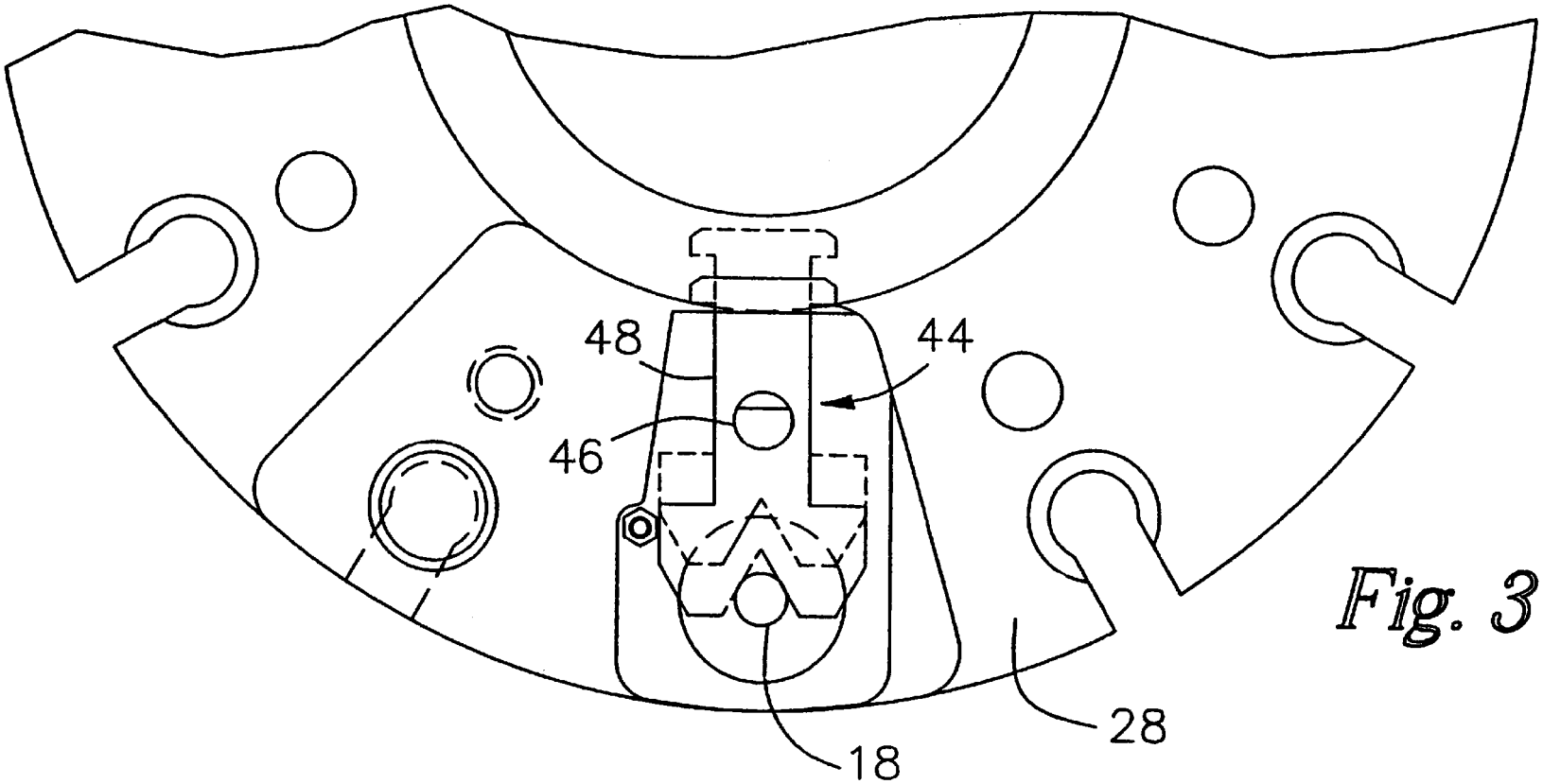
FIG. 3 is an enlarged top view of a centering mechanism.

As shown in greater detail in FIGS. 2*c* and 3, the first turret 11 has a support plate 28 upon which the blanks 18 are carried. The blanks 18 are positioned over dies 30 which have central openings 32 aligned with the first drawing sets 15 (FIGS. 2*b* and 2*c*). Each drawing set 15 has a punch 34 which moves between retracted and extended positions (as illustrated at the left and right sides, respectively, of FIGS. 2*b* and 2*c*). In the extended position, the punch 34 extends through the die opening 32 to form a case 20. An amount of excess blank material is not forced through the die, but instead forms a flange 21 around a top of the case 20. In the retracted position, the punch 34 retreats to a position spaced from the die 30 (above the die according to FIG. 2*b*). As the punch retracts, the case 20 remains attached to the punch 34 to thereby remove the case 20 from the die 30.

Each first drawing set 15 also includes a redraw sleeve 36 which is concentric with the punch 34 and is actuated between retracted and extended positions (as illustrated at the left and right sides, respectively, of FIGS. 2*b* and 2*c*). The redraw sleeve 36 has an inner bore 37 shaped and sized to closely fit the punch 34. In the extended position, the redraw sleeve 36 clamps the blank 18 against the die 30. In the retracted position, the redraw sleeve 36 is spaced from the blank 18 so that the blank is no longer clamped in place. The redraw sleeve 36 also acts as a stripper to remove the formed case from the punch 34, as described in greater detail below.

Each first drawing set 15 further incorporates an ejector 38 for supporting the case 20 after it has been stripped from the punch 34. The ejector 38 is operated between extended and retracted positions (as shown at the left and right sides, respectively, of FIG. 2*c*). According to the embodiment illustrated in FIG. 2*c*, in the retracted position, a head 40 of the ejector 38 is located below a bottom surface of the die 30 to allow the blank 18 to be formed into a case 20 by the punch 34. In the extended position, the head 40 of the ejector 38 extends through the die opening 32 until a top end is substantially even with the top of the die 30. Stripped cases then fall back toward the die 30 but are supported by the ejector 38 until passed to a transfer wheel.

Figure 5A:
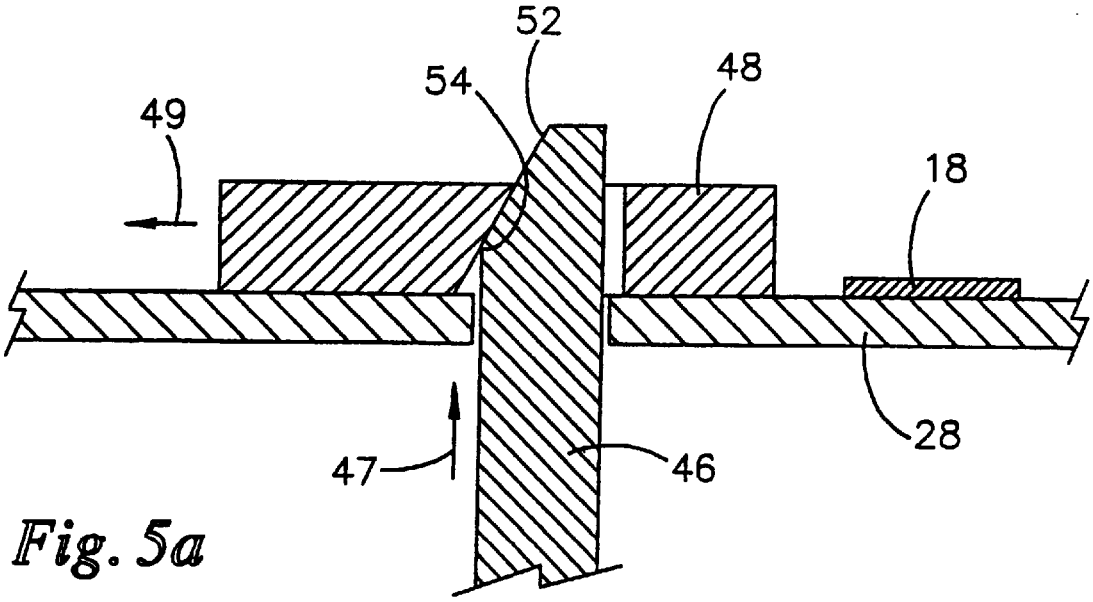
FIGS. 5*a–b* are sectional side views of the centering mechanism centering a blank and retreating.
Figure 5B:
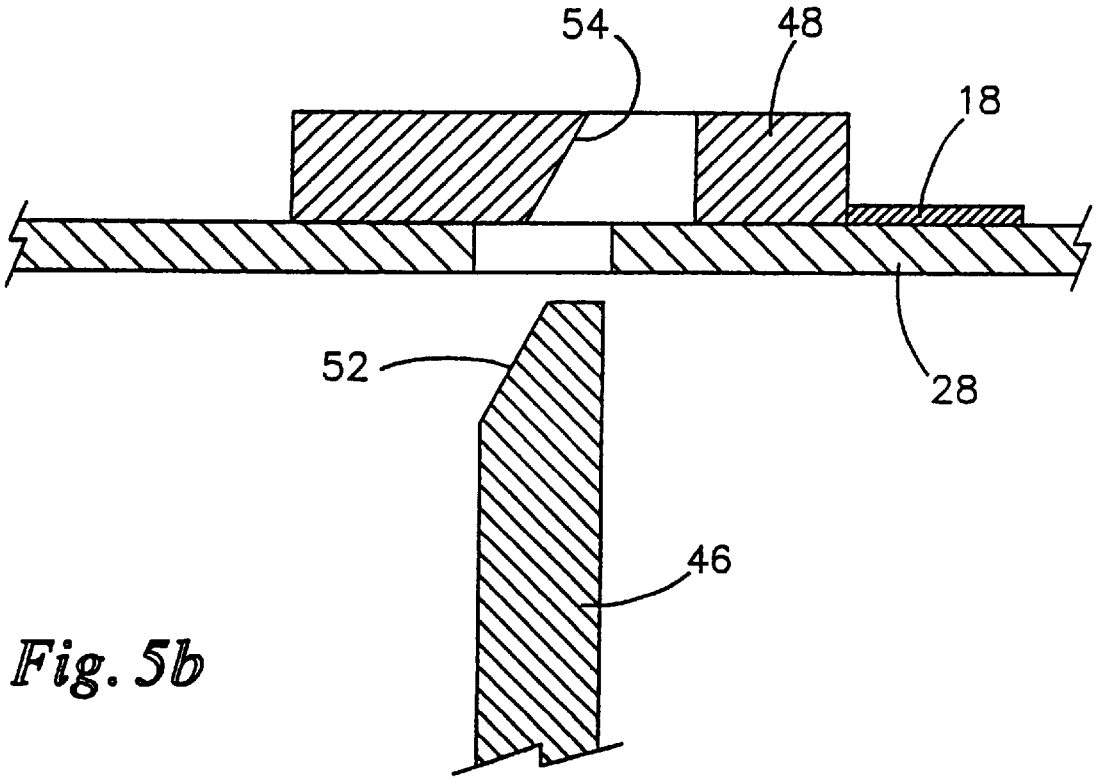

In accordance with certain objects of the present invention, each first drawing set 15 further incorporates a centering mechanism 44 for positioning the workpieces over the dies 30 (FIGS. 5*a* and 5*b*). The centering mechanism 44 comprises a rod 46 for camming an arm 48 between centered and retracted positions, as shown in FIGS. 5*b* and 5*a*, respectively. A top end of the rod 46 has a slanted surface 52 which engages a complementary surface 54 of the arm 48. The slanted surface 52 and complementary service 54 engage one another so that as the rod 46 is actuated up and down, the arm 48 operates between centered and retracted positions. In the preferred embodiment, the arm 48 is spring loaded in the centered position to ensure engagement between the slanted and complementary surfaces 52, 54.

In operation, multiple cams drive the components of the first drawing sets 15 so that drawing operations are performed as the first rotary turret 11 rotates. As best shown in FIG. 2*a,* a drive cam 60 is attached to a top plate 61 and engages a top cam follower 62 to thereby drive the punch 34 toward the extended position. A return cam 63, also extending from the top plate 61, engages a bottom cam follower 64 to actuate the punch 34 back toward the retracted position as the turret 12 continues to rotate.

Similarly, a drive cam 70 attached to a second plate 71 engages a top cam follower 72 to drive the redraw sleeve 36 toward the extended position, and a return cam 73 engages a bottom cam follower 74 to actuate the redraw sleeve 36 toward the retracted position (FIG. 2*b*). The ejector 38 has bottom and top cam followers 80, 81 for engaging drive and return cams 82, 83 to actuate the ejector 38 toward extended and retracted positions, respectively.

Finally, the rod 46 of the centering mechanism 44 is actuated by a drive cam 90 to move the arm 48 between centered and retracted positions. The drive cam 90 engages a bottom cam follower 91 to drive the arm 48 toward the centered position. A return cam 92 engages a top cam follower 93 to drive the arm 48 back toward the retracted position. The arm 48 engages a periphery of the blank 18 so that, when the arm is in the centered position, the blank 18 is axially aligned with the drawing set 15. In the retracted position, the arm 48 does not interfere with the other components of the drawing set 15 as they perform a drawing operation. The centering mechanism 44, therefore, automatically centers the blanks 18 over the dies 30 so that each blank may be deep drawn.

Operation of the first turret 11 will now be described. The cams of the first turret 11 are oriented so that the components of the first drawing sets 15 perform a complete drawing operation as the turret rotates. Accordingly, the arm 48 is actuated to the centered position to center the blank 18 with one of the first drawing sets 15. The redraw sleeve 36 is operated toward the extended position to pin the blank 18 against the die 30 while, at approximately the same time, the punch 34 moves toward the extended position to punch the blank 18 through the die opening 32 to form a case 20. Although not necessary in all situations, the arm 48 then moves to the retracted position before the punch 34 and redraw sleeve 36 begin to retract and the ejector 38 moves toward the extended position. In certain applications, the arm 48 must retract to avoid interfering with the flange 21 of the case 20 as it is removed from the die 30. In other applications, it will be appreciated that the case 20 as formed has a significantly smaller overall diameter than the blank 18, such that the flange 21 does not interfere with the arm 48. In the latter situation, the arm 48 may remain in the centered position. When the redraw sleeve 36 has retracted to a strip position, located approximately at a height above the die that is slightly greater than the height of the case 20, the redraw sleeve 36 pauses while the punch 34 continues to retract. As a result, the redraw sleeve 36 strips the case 20 from the punch 34. In the preferred embodiment, the redraw sleeve 36 is sized to engage the flange 21 of the case 20 at the strip position. The stripped case 20 is deposited on the extended ejector 38.

Approximately simultaneous to the pausing of the redraw sleeve 36, the arm 48 returns to the centered position (if it had previously retracted) to help position the case 20 as it is deposited on the ejector 38. After the case 20 is stripped, the redraw sleeve 36 resumes travel toward the retracted position while the punch continues its movement. The arm 48 and ejector 38 remain in the centered and extended positions until the case 20 is deposited onto the transfer wheel 14. The ejector 38 and arm 48 then move toward their respective retracted positions. In this manner, it will be appreciated that each drawing set 15 performs a deep drawing operation on a blank 18 as the first turret 11 rotates.

It will further be appreciated that, in the preferred embodiment, the first turret 11 carries a plurality of substantially identical drawing sets 15 so that multiple blanks 18 may be deep drawn at the same time. The drawing sets 15 are spaced radially about the turret 11 so that each drawing set is at a different stage of the deep drawing process, thereby reducing the level of noise generated.

The drawing apparatus 10 includes the intermediate turret 12 to perform redraw operations. As illustrated in FIG. 1, the intermediate turret 12 carries a plurality of substantially identical drawing sets 16. The drawing sets 16 comprise components which are quite similar to those described above in conjunction with the first turret 12, including a punch 34, redraw sleeve 36, ejector 38, and centering mechanism 44. The only significant difference from the first drawing sets 15 is that the components of the intermediate drawing sets 16 are sized to form a different sized case 20. Because they are so similar, a separate figure illustrating the components of the intermediate drawing sets 16 has not been provided and instead reference will be made to FIGS. 2*a*–2*d*, using the same reference numerals for the same components.

While the intermediate turret 12 receives formed cases 20 instead of blanks 18, the intermediate drawing sets 16 operate quite similar to the first drawing sets 15. The arm 48 moves toward the centered position to provide initial centering of the case 20 over the die 30. The redraw sleeve 36 is inserted inside the case 20 and clamps a bottom of the case 20 to the die 30. It will be appreciated that the redraw sleeve 36 may be sized to closely fit inside the case 20, thereby more accurately aligning the case 20 with the die 30 to provide final centering of the case 20. The remainder of the operation of the intermediate turret 12 is substantially identical to that described above for the first turret 11. While the embodiment illustrated in FIG. 1 includes a single intermediate turret 12, it will be appreciated that a number of intermediate turrets 12 may be used, depending on the case material and the desired case depth and diameter.

According to the illustrated embodiment, the drawing apparatus 10 further includes a final turret 13 for forming relatively small diameter cases. As illustrated in FIG. 1, the final turret 13 carries a plurality of substantially identical final drawing sets 17, similar to the drawing sets of the first and intermediate turrets 11, 12. Again, the final drawing sets 17 comprise the same components as the first and intermediate drawing sets 15, 16, only sized to form a different sized finished case 22. The cases 20 fed into the final turret 13 have a small diameter which does not allow room for both a redraw sleeve and a punch. Accordingly, the final drawing sets 17 are operated so that the redraw sleeve 36 is not inserted inside the case 20 but instead stops at the strip position located above the die 30 at a distance approximately equal to slightly more than the height of the case to be formed. The final drawing set 17 then forms the finished case 22 in substantially the same manner as in the first and intermediate drawing sets 15, 16. As the punch 34 moves toward the retracted position, the redraw sleeve 36 engages the flange 21 of the finished case 22 to strip the case from the punch 34. Once the finished case 22 is stripped, the punch 34, redraw sleeve 36, centering mechanism 44, and ejector 38 operate in substantially the same fashion as in the first and intermediate drawing sets 15, 16. The finished case 22 is passed to an outfeed 24 for transfer to a staging area.

Figure 4A:
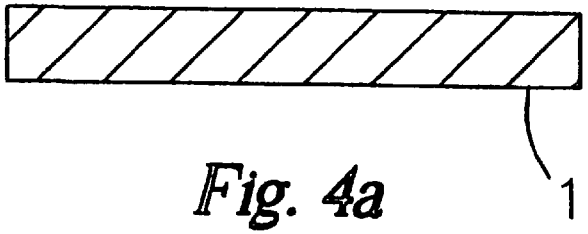
FIGS. 4*a–c* are sectional side views of a blank before being drawn, after a drawing operation, and after a first redrawing operation, respectively.
Figure 4B:
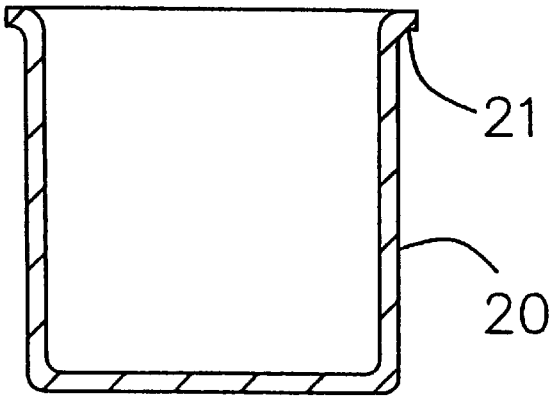
Figure 4C:
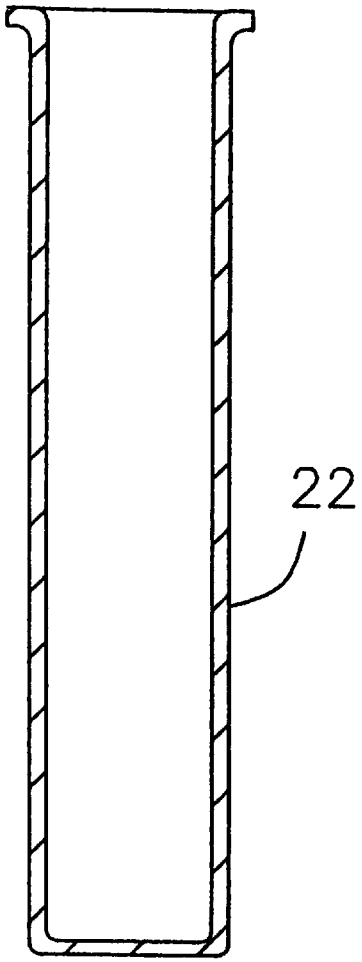

The shape of a workpiece as it progresses through drawing and redrawing operations are shown in FIGS. 4*a*–*c*. Initially, a blank 18 is generally flat and has a relatively thick cross-section (FIG. 4*a*). After a first drawing operation in the first turret 12, the blank is formed as a case 20 having a given diameter and length (FIG. 4*b*). It will be noted that the case 20 is formed with a flange 21. A redrawing operation in a subsequent turret 13 forms the finished case 22 having a smaller diameter and greater length (FIG. 4*c*). While the workpiece is illustrated as having a progressively thinner cross-section, as illustrated in FIGS. 4*a*–*c*, the case thickness need not necessarily change after each drawing operation.

The above-described drawing apparatus 10 includes a first turret 11, one or more intermediate turrets 12, and a final turret 13 to form blanks 18 into small diameter finished cases 22. It will be appreciated, however, that already formed cups or cases may be fed into the drawing apparatus 10, in which case the first turret 11 is not needed. Furthermore, the drawing apparatus 10 may be used to form larger diameter cases, and therefore the final turret 13 is not needed. The larger diameter cases may be formed from blanks 18, in which case the first turret 11 is needed, or cups, in which case the first turret 11 may be eliminated. Finally, it will be noted that one or more intermediate and final turrets 12, 13 may be used in the drawing apparatus 10, depending on the case material and desired case dimensions.

From the foregoing, it will be apparent that the present invention brings to the art a new and improved method and apparatus for drawing blanks into cases. The present invention incorporates the use of a rotary turret carrying a plurality of drawing means 16 which perform a drawing operation as the turret rotates. Blanks may therefore be continuously fed into the rotary turret and passed to subsequent turrets until the desired case dimensions are obtained. The method and apparatus advantageously incorporates a centering mechanism for automatically centering the workpieces with the drawing means. As a result, the present invention provides a method and apparatus for forming cases from blanks using a continuously operating rotary turret. Accordingly, the rate of production of cases is significantly increased over previously known methods and apparatus.

What is claimed is:

1. A method of drawing a workpiece into a battery case having relatively lone side walls and a relatively small diameter, the method comprising the steps of:

a. providing a plurality of drawing turrets for continuously partly drawing the battery cases, and transfer turrets positioned to pass workpieces or partly formed battery cases to subsequent drawing turrets, each of the drawing turrets comprising a continuously rotating support plate carrying a plurality of tool sets each including a punch and die and a centering mechanism, the plurality of tool sets of a first of the drawing turrets being of a larger diameter than the other pluralities of tool sets, and the plurality of tool sets of each successive drawing turret being of progressively smaller diameter;

b. loading the workpiece onto the continuously rotating support plate of a first drawing turret;

c. centering the workpiece over one of the dies with the centering mechanism;

d. drawing the workpiece with the punch associated with said one of the dies as the first drawing turret rotates, the punch operable between a retracted position, in which the punch is spaced from the die, and an extended position, in which the punch extends at least partially through the die, the punch operating from the retracted position by rotation of the first drawing turret to the extended position to draw the workpiece into the battery case;

e. removing the case from the die after drawing;

f. depositing the case onto a transfer turret for transfer to a successive drawing turret to ultimately reduce the diameter and increase the length of the case to battery size; and g. repeating the loading, centering, drawing, removing and depositing steps with a new workpiece for each tool set as the first drawing turret rotates.

2. The method of claim 1 in which the centering mechanism is translated between a centered position, in which the centering mechanism engages a periphery of the workpiece or case to center the workpiece or case over the die, and a retracted position, in which the centering mechanism is spaced from the workpiece or case, the centering mechanism operating from the retracted position to the centered position to center the workpiece or case.

3. The method of claim 2 in which the centering mechanism comprises an arm positioned to slide on the support plate, the arm engaging the workpiece or case in the centered position.

4. The method of claim 1 in which the plurality of tool sets include a plurality of substantially identical dies spaced angularly around the support plate and the drawing turret carries a plurality of punches, each punch aligned with a corresponding die, the tool sets spaced around the support plate and actuated in sequence as the turret rotates so that a plurality of cases are being drawn concurrently as the turret rotates.

5. The method of claim 4 wherein the plurality of cases are in different phases of drawing at any given instant so as to minimize the buildup of inpact noise from initial engagement of the tool sets with the workpiece.

6. The method of claim 2 in which the punch is actuated in a second direction opposite the first direction toward the retracted position to remove the case from the die.

7. The method of claim 6 in which each tool set further includes a redraw sleeve that is mounted on the drawing turret and rotates with the support plate, the redraw sleeve shaped to closely fit around the punch, the redraw sleeve operable to a strip position, in which the redraw sleeve is spaced from the die by about a case height, the redraw sleeve operating to the strip position before the punch reaches the retracted position so that the redraw sleeve strips the case from the punch.

8. The method of claim 7 in which, during the removal step, the centering mechanism is actuated toward the retracted position before the punch moves toward the retracted position, the centering mechanism remaining in the retracted position until the redraw sleeve nears the strip position, at which time the centering mechanism returns to the centered position.

9. The method of claim 7 in which the redraw sleeve is operable to an extended position in which the redraw sleeve clamps the workpiece to the die, the redraw sleeve operating to the extended position after the centering step and before the actuating step.

10. The method of claim 7 in which each tool set includes an ejector that is mounted on the drawing turret and rotates with the support plate, the ejector being aligned with the die and mounted opposite the punch, the ejector operable from a retracted position, in which the ejector is spaced from the die, to an extended position, in which the ejector extends at least partially through the die, the ejector actuating toward the extended position as the punch retracts during the removing step.

11. The method of claim 10 in which centering mechanism actuates back toward the centered position after the case is stripped, the centering mechanism remaining in the centered position and the ejector remaining in the extended position until the case is deposited onto the transfer turret.

12. The method of claim 10 in which the centering mechanism, punch, redraw sleeve, and ejector are operated by respective cams as the drawing turret rotates.

13. Drawing apparatus for drawing a workpiece into a battery case having relatively long side walls and a relatively small diameter, the drawing apparatus comprising:

a plurality of drawing turrets for continuously partly drawing the battery cases, and transfer turrets positioned to pass workpieces or partly formed battery cases to subsequent drawing turrets, each of the drawing turrets comprising:

a continuously rotating turret having a support wheel and carrying a plurality of tool sets each including a die and a concentric punch and redraw sleeve unit, a centering mechanism mounted on the turret and rotating with the support plate, the centering mechanism operable in a plane perpendicular to the punch between a retracted position, in which the centering mechanism is spaced from the workpiece, and a centered position in which the centering mechanism engages a periphery of the workpiece to center the workpiece over the die, each of the punches and redraw sleeve units mounted on the turret and rotating with the support plate, the punches being substantially aligned with the dies and operable between a retracted position, in which the punch is spaced from the die, and an extended position, in which the punch extends at least partially through the die to form the case, and means for operating the centering mechanism and punch and redraw sleeve units as the turret rotates, the operating means driving the centering mechanism toward the centered position before driving the punch to the extended position and the redraw sleeve to a clamp position, the operating means driving the punch back toward the retracted position after the case is drawn and the redraw sleeve to a position to strip the case from the punch; and the plurality of tool sets of a first of the drawing turrets being of a larger diameter than the other pluralities of tool sets, and the plurality of tool sets of each successive drawing turret being of progressively smaller diameter to ultimately reduce the diameter and increase the length of the case to batters size.

14. The drawing apparatus of claim 13 wherein the means for operating comprises cams and followers positioned to operate the punch and redraw sleeve units and centering mechanism as the turret rotates.

15. The drawing apparatus of claim 14 in which the cams and followers progressively drive the punches as the turret rotates so that drawing proceeds concurrently and progressively in the respective tool sets as the turret rotates.

16. The drawing apparatus of claim 15 wherein the redraw sleeve is mounted on the turret and rotates with the support plate, the redraw sleeve shaped to closely fit the punch and operable to a strip position, in which the redraw sleeve is spaced from the die by about a case height, the operating means actuating the redraw sleeve to the strip position before the punch is driven back toward the retracted position so that the redraw sleeve strips the case from the punch.

17. The drawing apparatus of claim 16 in which the die is shaped to form a flange around a top end of the case, the redraw sleeve sized to engage the flange in the strip position.

18. The drawing apparatus of claim 16 in which the redraw sleeve is further operable to an extended position, in which the redraw sleeve clamps the workpiece to the die, the operating means driving the redraw sleeve to the extended position after the workpiece is centered but before the punch reaches the extended position.

19. The drawing apparatus of claim 16 further comprising an ejector mounted on the turret and rotating with the support plate, the ejector being aligned with the die and mounted opposite the punch, the ejector operable between a retracted position, in which the ejector is spaced from the die, to an extended position, in which the ejector extends at least partially through the die, the operating means driving the ejector to the extended position as the punch is driven to the retracted position.

* * * * *

UNITED STATES PATENT AND TRADEMARK OFFICE

CERTIFICATE OF CORRECTION

PATENT NO. : 6,230,538 B1
DATED : May 15, 2001
INVENTOR(S) : James E. Ribordy

It is certified that error appears in the above-identified patent and that said Letters Patent is hereby corrected as shown below:

Claim 1,
Line 2, please delete "lone" and replace with -- long --

Signed and Sealed this

Thirteenth Day of November, 2001

*Attest:*

Nicholas P. Godici

NICHOLAS P. GODICI
*Acting Director of the United States Patent and Trademark Office*

*Attesting Officer*